US006088568A

United States Patent [19]

Ohtani

[11] Patent Number: 6,088,568

[45] Date of Patent: Jul. 11, 2000

[54] IMAGE FORMING APPARATUS WHICH PREVENTS IMPROPER STAPLING AND PUNCHING OPERATIONS

[75] Inventor: Masaki Ohtani, Zama, Japan

[73] Assignee: Ricoh Company, Ltd., Tokyo, Japan

[21] Appl. No.: 09/030,762

[22] Filed: Feb. 26, 1998

[30] Foreign Application Priority Data

Mar. 3, 1997 [JP] Japan ..... 9-048305

[51] Int. Cl.[7] ..... G03G 15/00

[52] U.S. Cl. ..... 399/408; 270/58.07; 399/410

[58] Field of Search ..... 399/408, 410, 399/407; 270/37, 58.01, 58.09, 58.07

[56] References Cited

U.S. PATENT DOCUMENTS 4,763,167 8/1988 Watanabe et al. ..... 399/410

4,864,350 9/1989 Ishiguro et al. ..... 399/408 X 5,508,798 4/1996 Yamada ..... 399/410

FOREIGN PATENT DOCUMENTS 3-107962 5/1991 Japan .

*Primary Examiner*—Quana Grainger

*Attorney, Agent, or Firm*—Oblon, Spivak, McClelland, Maier & Neustadt, P.C.

[57] ABSTRACT

An image forming apparatus includes a staple/punch device which staples/punches a sheet output from the image forming apparatus in a predetermined area relative to an output sheet receiving unit of the apparatus, staple and/or punch position designating devices which designate a staple and/or punch position for the output sheet and a staple and/or punch instructing device which gives a staple and/or punch instruction to the staple/punch device. When the designated staple/punch position is out of the predetermined area, a staple/punch instruction deleting device can delete the staple/punch instruction.

2 Claims, 13 Drawing Sheets

PORTRAIT IMAGE PRINTING
LENGTHWISE SHEET FEEDING

| STAPLE/PUNCH PATTERN / SHEET SIZE | | (A) UPPER LEFT SLANTING | (B) UPPER RIGHT SLANTING | (C) LEFT DOUBLE | (D) UPPER DOUBLE | (E) RIGHT DOUBLE | (F) UPPER LEFT HORIZONTAL | (G) UPPER RIGHT HORIZONTAL |
|---|---|---|---|---|---|---|---|---|
| A3R, B4R | SIMPLEX | DELETE | 180 | DELETE | 180 | DELETE | 180 | 180 |
| DLR, LGR | DUPLEX UPPER | DELETE | 180 | DELETE | 180 | DELETE | 180 | 180 |
| A4R, B5R | DUPLEX LEFT | DELETE | DELETE | DELETE | DELETE | DELETE | 180 | DELETE |
| LTR, EXR | DUPLEX RIGHT | DELETE | 180 | DELETE | DELETE | DELETE | DELETE | 180 |
| OTHER THAN ABOVE | | DELETE | | | | | | |
| STAPLE REFERENCE | | 0 | 12 | 2 | 14 | 10 | 15 | 13 |
| PUNCH REFERENCE | | | (3) | 0 | 3 (3) | 2 | (3) | (3) |

*FIG. 3*

LANDSCAPE IMAGE PRINTING
LENGTHWISE SHEET FEEDING

| STAPLE/PUNCH PATTERN / SHEET SIZE | | (A) UPPER LEFT SLANTING | (B) UPPER RIGHT SLANTING | (C) LEFT DOUBLE | (D) UPPER DOUBLE | (E) RIGHT DOUBLE | (F) UPPER LEFT PERPENDICULAR | (G) UPPER RIGHT PERPENDICULAR |
|---|---|---|---|---|---|---|---|---|
| A3R, B4R | SIMPLEX | 0 | DELETE | 0 | DELETE | 180 | 0 | 180 |
| DLR, LGR | DUPLEX UPPER | 0 | DELETE | DELETE | DELETE | DELETE | 0 | 180 |
| A4R, B5R | DUPLEX LEFT | 0 | DELETE | 0 | DELETE | DELETE | 0 | DELETE |
| LTR, EXR | DUPLEX RIGHT | DELETE | DELETE | DELETE | DELETE | 180 | DELETE | 180 |
| OTHER THAN ABOVE | | DELETE | | | | | | |
| STAPLE REFERENCE | | 0 | 12 | 2 | 14 | 10 | 1 | 11 |
| PUNCH REFERENCE | | (0) | | 0 (0) | 3 | 2 (2) | (0) | (2) |

*FIG. 4*

PORTRAIT IMAGE PRINTING
SIDEWAYS SHEET FEEDING

| STAPLE/PUNCH PATTERN / SHEET SIZE | | | (A) | (B) | (C) | (D) | (E) | (F) | (G) |
|---|---|---|---|---|---|---|---|---|---|
| | | | ABC | ABC | ABC | ABC | ABC | ABC | ABC |
| | | | UPPER LEFT SLANTING | UPPER RIGHT SLANTING | LEFT DOUBLE | UPPER DOUBLE | RIGHT DOUBLE | UPPER LEFT PERPENDICULAR | UPPER RIGHT PERPENDICULAR |
| A3, B4, DL, LG | | | | | | | | | |
| A4, B5 LT, EX | SIMPLEX | | 0 | DELETE | 0 | DELETE | 180 | 0 | 180 |
| | DUPLEX | UPPER | 0 | DELETE | DELETE | DELETE | DELETE | 0 | 180 |
| | | LEFT | 0 | DELETE | 0 | DELETE | DELETE | 0 | DELETE |
| | | RIGHT | DELETE | DELETE | DELETE | DELETE | 180 | DELETE | 180 |
| OTHER THAN ABOVE | | | DELETE | | | | | | |
| STAPLE REFERENCE | | | 0 | 12 | 2 | 14 | 10 | 1 | 11 |
| PUNCH REFERENCE | | | (0) | | 0 (0) | 3 | 2 (2) | (0) | (3) |

*FIG. 5*

LANDSCAPE IMAGE PRINTING
SIDEWAYS SHEET FEEDING

| STAPLE/PUNCH PATTERN / SHEET SIZE | | | (A) ABC UPPER LEFT SLANTING | (B) ABC UPPER RIGHT SLANTING | (C) ABC LEFT DOUBLE | (D) ABC UPPER DOUBLE | (E) ABC RIGHT DOUBLE | (F) ABC UPPER LEFT HORIZONTAL | (G) ABC UPPER RIGHT HORIZONTAL |
|---|---|---|---|---|---|---|---|---|---|
| A3, B4, DL, LG | | | | | | | | | |
| A4, B5 LT, EX | SIMPLEX | | DELETE | 180 | DELETE | 180 | DELETE | 180 | 180 |
| | DUPLEX | UPPER | DELETE | 180 | DELETE | 180 | DELETE | 180 | 180 |
| | | LEFT | DELETE | DELETE | DELETE | DELETE | DELETE | 180 | DELETE |
| | | RIGHT | DELETE | 180 | DELETE | DELETE | DELETE | DELETE | 180 |
| OTHER THAN ABOVE | | | DELETE | | | | | | |
| STAPLE REFERENCE | | | 0 | 12 | 2 | 14 | 10 | 15 | 13 |
| PUNCH REFERENCE | | | | (3) | 0 | 3 (3) | 2 | (3) | (3) |

*FIG. 6*

IMAGE FORMING APPARATUS WHICH PREVENTS IMPROPER STAPLING AND PUNCHING OPERATIONS

FIELD OF THE INVENTION

The present invention relates to an image forming apparatus such as a copier, facsimile, printer, or the like, and more particularly relates to an image forming apparatus which staples or punches sheets in an efficient manner.

DISCUSSION OF THE BACKGROUND

FIG. 8 is a block diagram illustrating a structure of a background image forming apparatus having a so-called finisher function. Generally, the finisher function refers to a function to staple and/or punch sheets output from an image forming apparatus. As shown in FIG. 8, an image forming apparatus 500 is constructed of an image forming unit 501 and a finisher 2. A control unit 511 of the image forming unit 501 controls an operation of the image forming apparatus 500. When a print command is received from an external host computer "C", an image generating unit 12 interprets the print command and generates bit-mapped image data, and an image forming device 13 forms an image on a sheet according to the image data. The finisher 2 includes a sheet output tray 21 on which sheets are output from the image forming unit 501, a staple unit 22 which staples the output sheets, and a punch unit 23 which punches the output sheets. The finisher 2 staples or punches the output sheets according to a staple or punch instruction included in the print command. When the instruction for stapling or punching is input through an operational display panel 14, the control unit 511 controls the finisher 2 to staple or punch the output sheets according to the input instruction.

FIG. 9 is a schematic drawing illustrating a construction of the finisher 2 shown in FIG. 8. Numeral 20 denotes a staple/punch unit (a combination of 22, 23 from FIG. 8). The staple/punch unit 20 is movable along an edge of the sheet output tray 21. The unit 20 is also movable along a curved line at the side of an user "U" operating the apparatus 500. A letter "M" denotes an area where the staple/punch unit 20 is movable.

FIG. 10 is a schematic drawing illustrating positions where the staple/punch unit 20 can staple or punch. As illustrated in FIG. 10, the staple/punch unit 20 can staple or punch sheets in a position "S" or "H" in parallel with a side P1 of a sheet "P" (in parallel with the right side edge of the sheet "P" when viewed from the user "U") or staples slantingly in a position "S" at a side corner P2 of the sheet "P" (at the front right side corner of the sheet "P" when viewed from the user "U").

FIG. 11 is a diagram illustrating an example of a menu for selecting a stapling/punching position and a stapling/punching pattern, which is displayed in the operational display panel 14 of the apparatus 500 or a display of the host computer "C". As menus for specifying a stapling position, there are shown such positions as "right side", "left side", "upper right", "upper left", "lower right" and "lower left" positions. As menus for a stapling pattern, there are shown such patterns as "horizontal", "perpendicular", "slanting" and "double" patterns. The user "U" selects and inputs a desired staple position and a desired staple pattern from among these menu choices. A punching position and a punching pattern are also selected and input in a similar manner. Also, there are shown menus for selecting a duplex print (forming an image on both sides of a sheet) or a simplex print (forming an image on one side of a sheet), and menus for selecting a binding side for the duplex print. When the user selects the duplex print and specifies a binding side for the sheet, such as "upper" binding, "left" binding or "right" binding, the apparatus forms an image on a sheet so as to have a binding margin at the specified side.

FIGS. 12(*a*) and 12(*b*) are diagrams illustrating conceivable positions and patterns for stapling and punching, respectively. It is possible to staple or punch sheets in all of the positions shown in FIGS. 12(*a*) and 12(*b*) if the staple/punch unit 20 can be moved along and around the entire circumference of the sheet "P". However, the finisher 2 will become complicated and large and consequently expensive if the staple/punch unit 20 is so constructed as to move around the entire circumference of the sheet "P". Therefore, the staple/punch unit 20 is generally so constructed as to move only in a predetermined area as illustrated in FIG. 9.

Accordingly, the image forming apparatus 500 can staple or punch only in the positions shown in FIG. 10. In other words, the image forming apparatus 500 can not staple or punch in other positions than those shown in FIG. 10.

When the image forming apparatus 500 is used in a network environment, the apparatus 500 is rarely placed at a location near the user "U". Therefore, generally the user "U" inputs the position and the pattern of stapling or punching without knowing the feeding direction of the sheets in the apparatus 500. For example, when the user inputs to staple in the "left side" position with "double" pattern for a portrait image and when the sheet "P" in the apparatus 500 is fed sideways as illustrated in FIG. 13(*a*), the apparatus 500 can staple the sheets as input because the "left side" of the sheet "P" is within the area "M". However, when the sheet "P" is fed lengthwise as shown in FIG. 13(*b*), then the apparatus 500 cannot staple in the "left side" position as input because the "left side" of the sheet "P" is not within the area "M". In such a case, generally the print command is canceled as an error and the printing operation is not performed. Consequently, printing productivity is lowered. A similar problem occurs when punching.

SUMMARY OF THE INVENTION

The applicants of the present invention have recognized that a needs exists for an image forming apparatus which efficiently performs stapling or punching, and which thereby improves productivity of the apparatus.

The present invention provides a novel image forming apparatus which efficiently performs stapling or punching, and which thereby improves productivity of the apparatus.

One embodiment of an image forming apparatus according to the present invention includes a staple device which staples sheets output from the apparatus in a predetermined area relative to an output sheet receiving unit of the apparatus, a staple position designating device which designates a staple position for the output sheets, and a staple instructing device which gives a staple instruction to the staple device. When the staple position designated by the staple position designating device is out of the predetermined area, a staple instruction deleting device deletes the staple instruction.

Another embodiment of the novel image forming apparatus according to the present invention includes a novel image forming device which forms an image according to a print instruction including a stapling instruction from an external source and which outputs a sheet carrying the image to an output sheet receiving unit. A staple device staples sheets output from the apparatus in a predetermined area relative to the output sheet receiving unit of the apparatus in accordance with the stapling instruction. When the staple instruction includes a staple instruction to staple in a position out of the predetermined area, a staple instruction deleting device deletes the staple instruction from the print instruction.

In each of the above embodiments, a determination as to whether the designated staple position is out of the predetermined area is made based upon information of a direction in which an image is formed on the sheet, a size of the sheet, and a staple pattern included in the staple instruction.

Further, when an image is formed on both sides of the sheet with a binding margin at a designated side of the sheet and if the staple position designated by the staple position designating device contradicts the designated binding side for the sheet, then the staple instruction deleting device deletes the staple instruction.

Furthermore, the novel image forming apparatus of the present invention includes a novel image data rotating device. The device rotates image data for printing for changing a positional relation between the image on the sheet and the predetermined area so as to staple the sheet in the predetermined area. For example, when a portrait image is formed on a sheet which is fed lengthwise and an upper position of the sheet is designated for stapling, stapling is not possible because the designated upper position of the sheet is out of the predetermined area. However, if the image data is rotated 180° for printing, then the upper position of the sheet will be disposed within the predetermined area and stapling in the designated position becomes possible.

Another embodiment of the novel image forming apparatus according to the present invention includes a novel punch device which punches sheets output from the apparatus in the predetermined area relative to the output sheet receiving unit of the apparatus, a punch position designating device which designates a punch position for the output sheets, and a punch instructing device which gives a punch instruction to the punch device. When the designated punch position is out of the predetermined area, a punch instruction deleting device deletes the punch instruction.

When the novel image forming apparatus according to the present invention forms an image according to a print instruction including a punch instruction from an external source, and if the punch instruction includes a punch instruction to punch in a position out of the predetermined area, then the punch instruction deleting device deletes the punch instruction from the print instruction. A determination as to whether the punch position is out of the predetermined area is made based upon information of a direction in which the image is formed on the sheet, a size of the sheet, and a punch pattern included in the punch instruction. Further, when an image is formed on both sides of the sheet with a binding margin at a designated side of the sheet, and if the punch position contradicts the designated binding side for the sheet, then the punch instruction deleting device deletes the punch instruction. Furthermore, the image data rotating device rotates image data for printing for changing a positional relation between the image on the sheet and the predetermined area so as to punch the sheet in the predetermined area.

When both the staple instruction and the punch instruction are made at the same time, and if the stapling position and the punching position contradict each other, then the punch instruction deleting device deletes the punch instruction.

BRIEF DESCRIPTION OF THE DRAWINGS

A more complete appreciation of the present invention and many of the attendants advantages thereof will be readily obtained by reference to the following detailed description when considered in connection with the accompanying drawings, wherein:

FIGS. 3, 4, 5, and 6 are diagrams explaining in which cases a staple or punch instruction is deleted;

FIG. 7(*b*) is a diagram illustrating exemplary positions for punching with respective reference numerals according to the present invention;

FIG. 12(*b*) is a diagram illustrating exemplary positions for punching and patterns of punching;

FIG. 13(*b*) is a diagram illustrating a case in which a sheet carrying a portrait image is fed lengthwise and explaining that stapling or punching is not possible.

DESCRIPTION OF THE PREFERRED EMBODIMENTS

Figure 1:
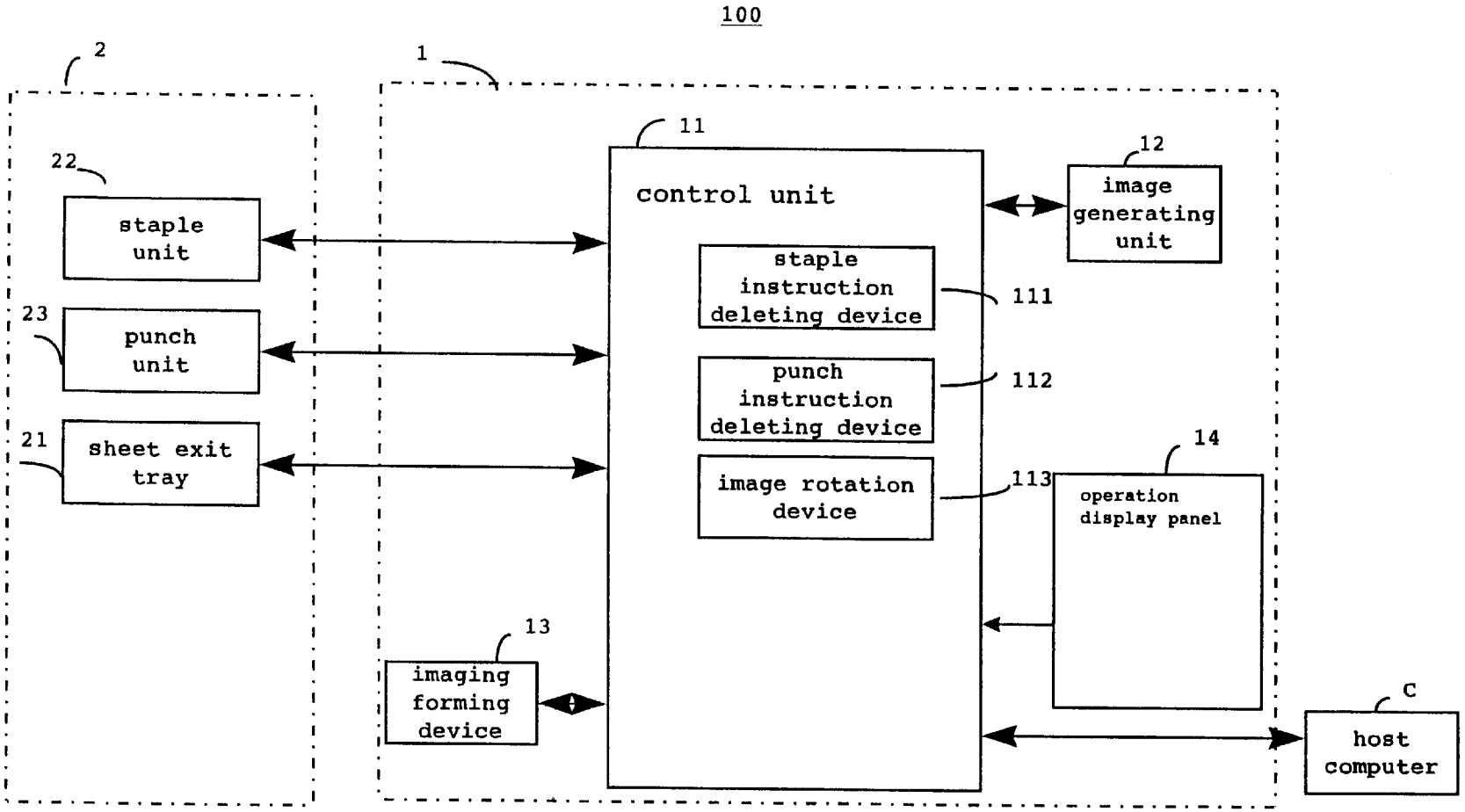
FIG. 1 a block diagram illustrating an exemplary construction of an image forming apparatus according to the present invention.

Referring now to the drawings, wherein like reference numerals designate identical or corresponding parts throughout the several views, embodiments of the present invention are explained herein below.

FIG. 1 is a block diagram illustrating an exemplary construction of an image forming apparatus 100 according to the present invention. The image forming apparatus 100 is constructed of an image forming unit 1 and a finisher 2. A control unit 11 of the image forming unit 1 controls an operation of the apparatus 100. When a print command is received from an external host computer "C", an image generating unit 12 interprets the print command and generates bit-mapped image data, and an image forming device 13 forms an image on a sheet according to the image data. The finisher 2 staples or punches the output sheet under control of the control unit 11 according to a staple or punch instruction included in the print command. When the instruction for stapling or punching is input through an operational display panel 14 of the apparatus 100, the control unit 11 controls the finisher 2 to staple or punch the output sheet according to the input instruction.

The control unit 11 includes a staple instruction deleting device 111 which deletes a staple instruction included in the print command from the host computer "C" when stapling cannot be performed in accordance with the staple instruction, and a punch instruction deleting device 112 which deletes a punch instruction included in the print command from the host computer "C" when punching cannot be performed in accordance with the punch instruction. An image rotation device 113 rotates the image data generated by the image generating device 12 180° for forming the image as rotated on the sheet.

The finisher 2 includes a sheet output tray 21 on which sheets are output from the image forming unit 100, a staple unit 22 which staples the output sheets, and a punch unit 23 which punches the output sheets.

Figure 9:
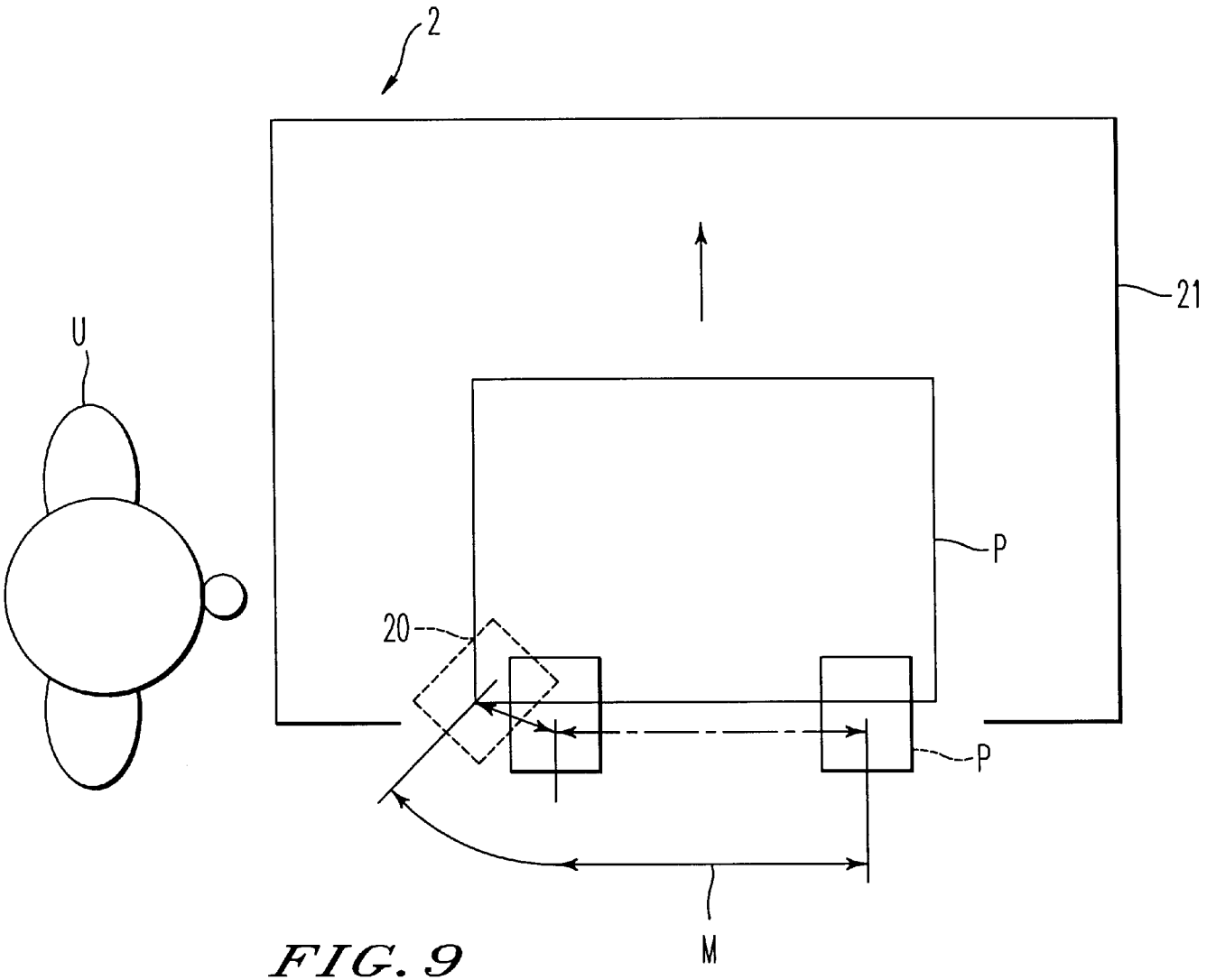
FIG. 9 PRIOR ART
FIG. 9 is a schematic drawing illustrating a construction of a finisher part of the apparatus illustrated in FIG. 8.
Figure 10:
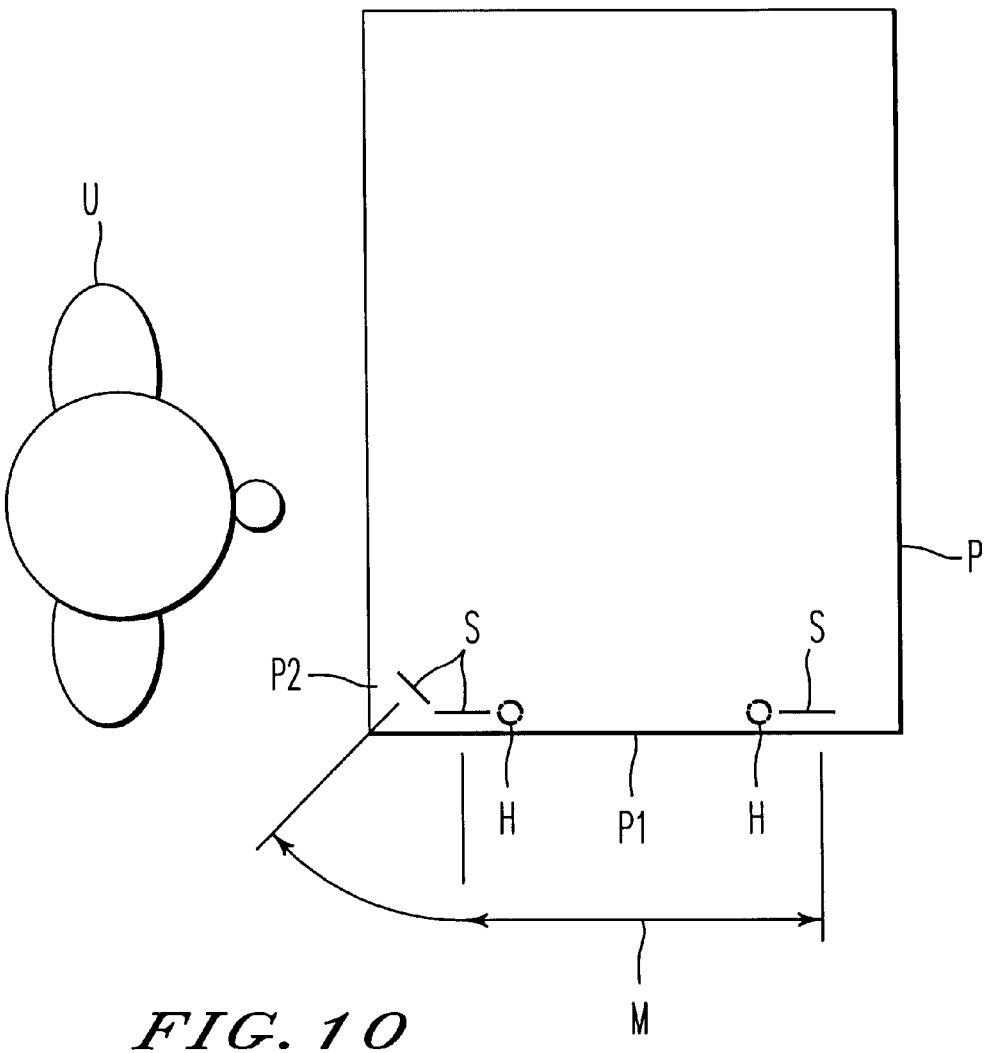
FIG. 10 PRIOR ART
FIG. 10 is a schematic drawing illustrating positions in which the finisher of FIG. 9 can staple or punch a sheet.
Figure 11:
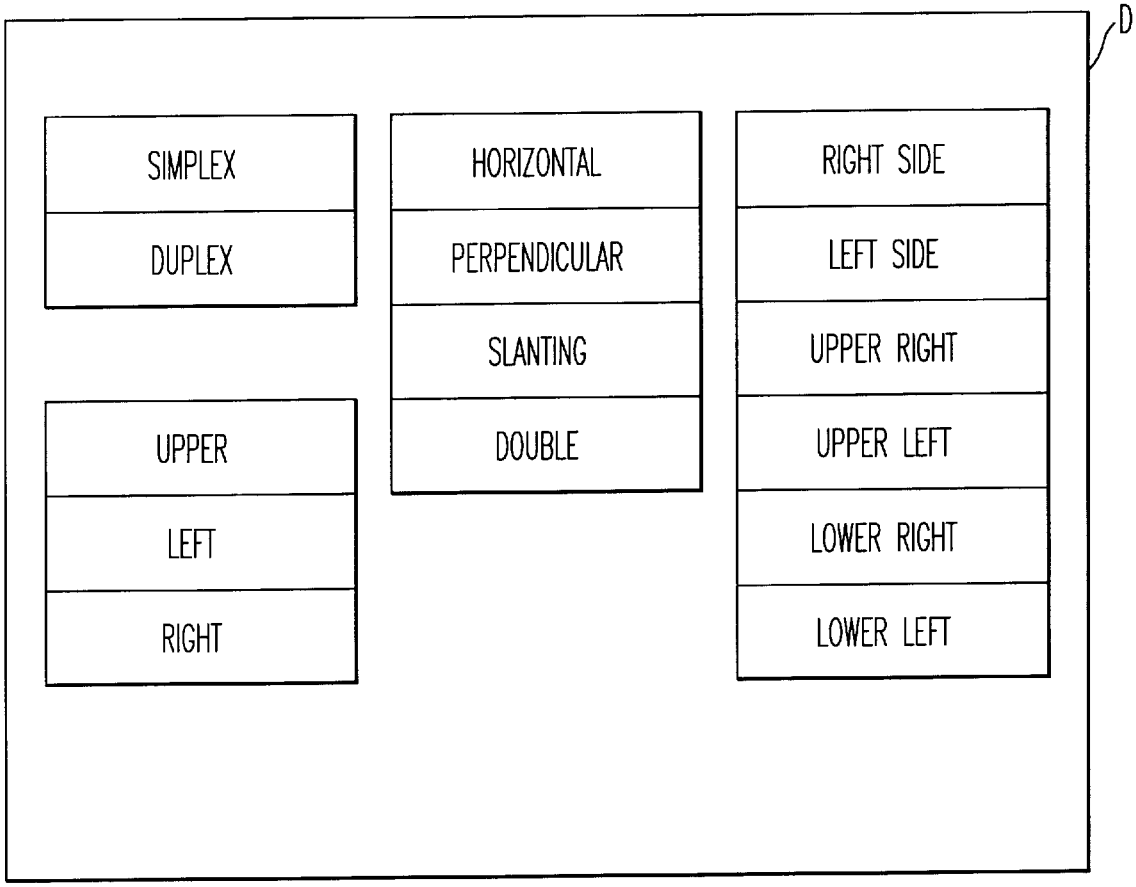
FIG. 11 PRIOR ART
FIG. 11 is a diagram illustrating an example of a menu which is displayed in an operational display panel of the apparatus shown in FIG. 8 or a display screen of an external host computer.
Figure 12B:
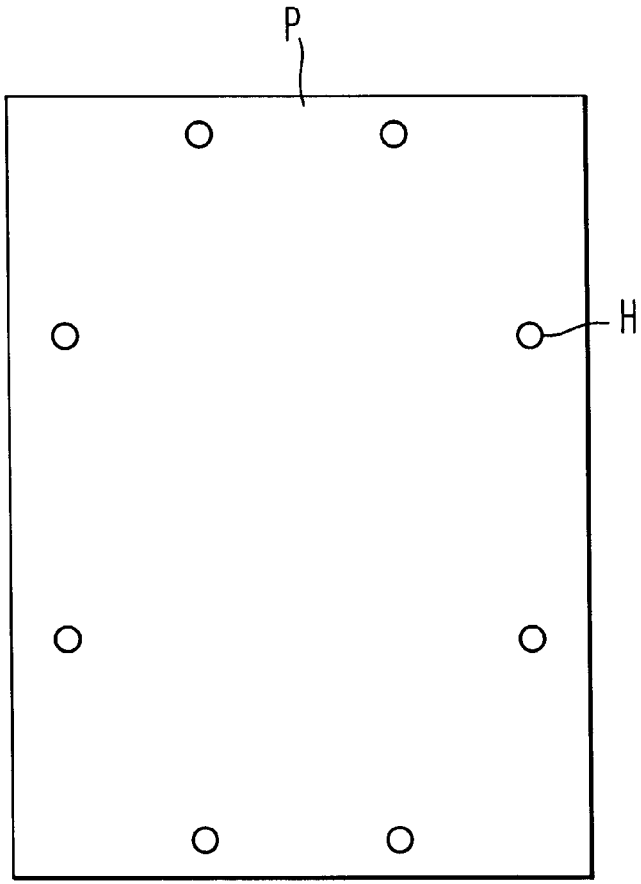
FIG. 12B PRIOR ART
FIG. 12(*a*) is a diagram illustrating exemplary positions for stapling and patterns of stapling.
Figure 12A:
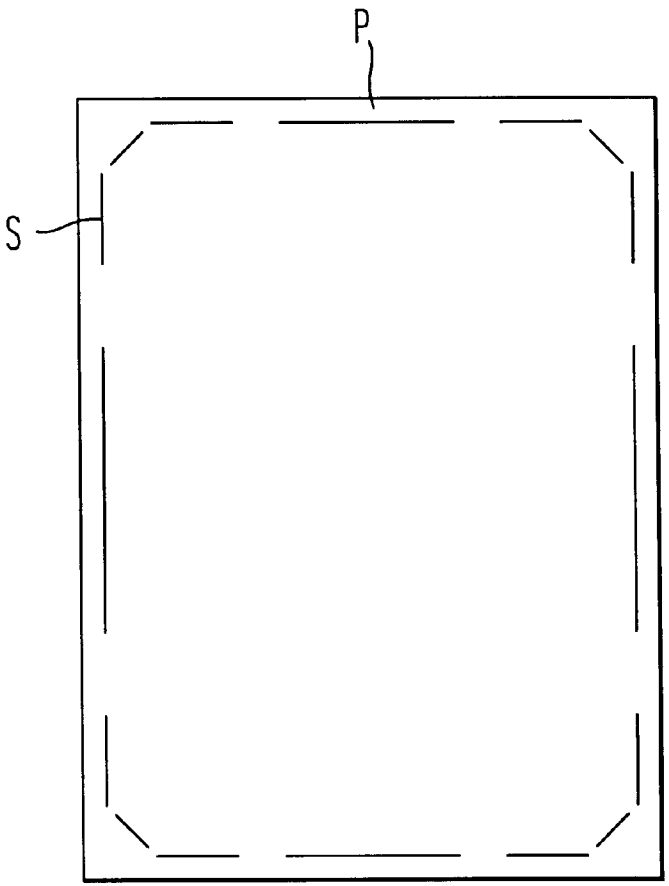
FIG. 12A PRIOR ART
Figure 13A:
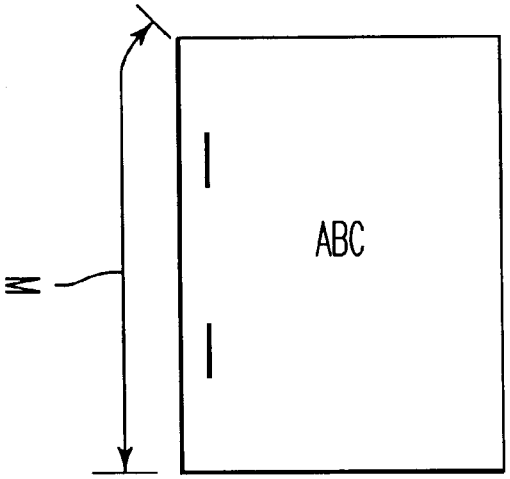
FIG. 13A PRIOR ART
FIG. 13(*a*) is a diagram illustrating a case in which a sheet carrying a portrait image is fed sideways and explaining that stapling or punching is possible.
Figure 13B:
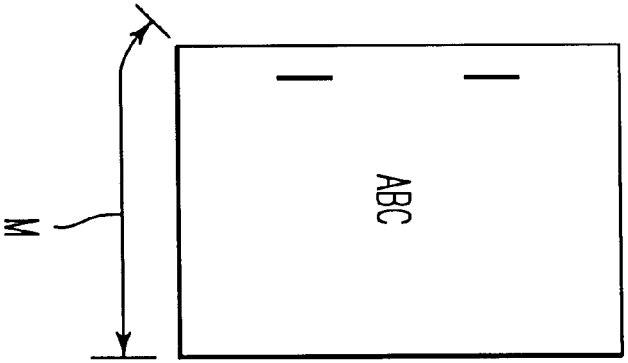
FIG. 13B PRIOR ART

The construction of the finisher 2 is substantially the same as illustrated in FIG. 9 and therefore illustration is omitted. As illustrated in FIG. 9, the staple/punch unit 20 (22, 23) is movable along an edge of the sheet output tray 21. The unit 20 is also movable along a curved line at the side of a user "U" operating the apparatus 100. The letter "M" denotes an area where the staple/punch unit 20 is movable. The staple/punch unit 20 staples or punches sheets in a position in parallel with a side P1 of a sheet "P" (in parallel with the right side edge of the sheet "P" when viewed from the user "U"), and staples slantingly in a position at a side corner P2 of the sheet "P" (at the front right side corner of the sheet "P" when viewed from the user "U"), as illustrated in FIG. 10.

Figure 2:
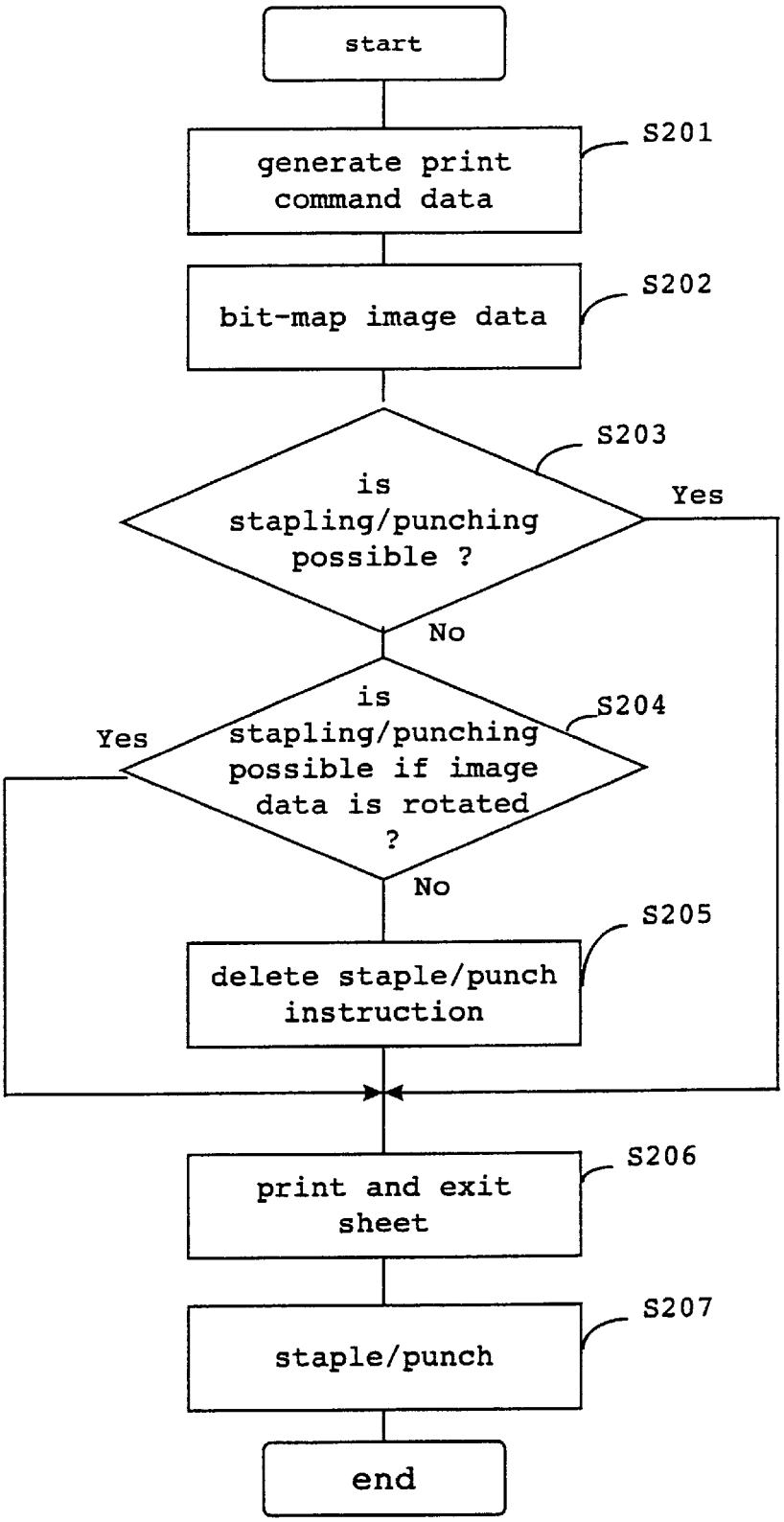
FIG. 2 is a flowchart illustrating an example of an operation of the apparatus illustrated in FIG. 1.

FIG. 2 is a flowchart illustrating an example of an operation of the image forming apparatus 100 illustrated in FIG. 1. FIGS. 3, 4, 5, and 6 are diagrams explaining in which cases a staple or punch instruction is deleted.

Referring to FIG. 2, in step S201, a printer driver of the host computer "C" generates a print command in accordance with information of printing conditions and information of a document for printing. The print command includes such commands for a print direction (portrait or landscape), a print sheet size, a duplex/simplex print instruction including an instruction of designating a side for binding, a stapling instruction, a stapling position, a stapling pattern, a punching instruction, a punching position, and a punching pattern. The print command can be sent from the host computer "C" to the image forming apparatus 100 through an interface (not shown), can be input from operation display panel 14, etc. In step S202, the image generating unit 12 interprets the print command and generates bit-mapped image data to store the image data in a RAM (not shown).

In step S203, a determination is made as to whether stapling or punching as instructed is possible. Also, a determination is made as to whether the stapling or punching position and/or pattern is contradictory to the content of the print instruction. Further, when both stapling and punching instructions are made, a determination is made as to whether the instructions contradict each other.

When the answer in step S203 is No, then in step S204, a determination is made as to whether stapling or punching is possible if the bit-mapped image data stored in the RAM is rotated 180° for printing. If the answer in step S204 is Yes, then the image rotation device 113 rotates the bit-mapped image data 180° and the image data is printed on a sheet as rotated, and the sheet carrying the image is output in step S206 to the sheet output tray 21.

If the answer in step S204 is No, in step S205, the stapling or punching instruction is deleted from the print command. The stapling instruction is deleted by the staple instruction deleting device 111 and the punching instruction is deleted by the punch instruction deleting device 112.

Now, how the determination is made as to whether stapling or punching is possible in steps S203 and S204 is explained referring to FIGS. 3, 4, 5, and 6. The determination is made based upon such information as the print direction (portrait or landscape), the print sheet size, the stapling position, the stapling pattern, the punching position, the punching pattern, whether the print is duplex or simplex, and the binding side when the print is duplex. The direction of the sheet in which the sheet is fed to be output to the sheet output tray 21 is determined by the direction in which the sheet is set in a sheet cassette of the apparatus 100 (not shown).

Figure 7B:
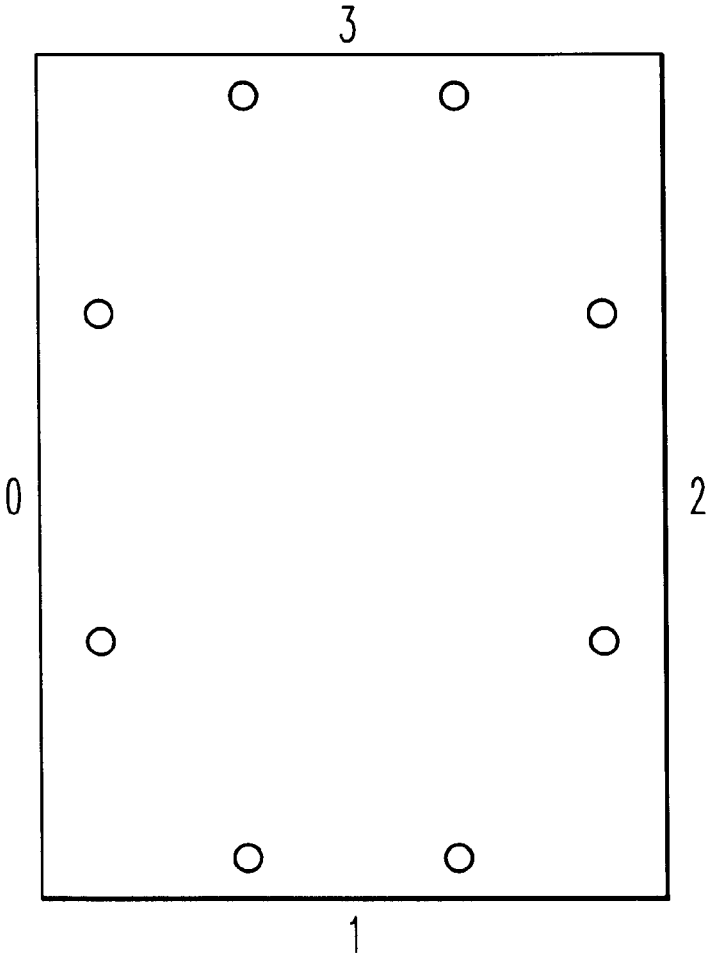
FIG. 7(*a*) is a diagram illustrating exemplary positions for stapling with respective reference numerals according to the present invention.
Figure 7A:
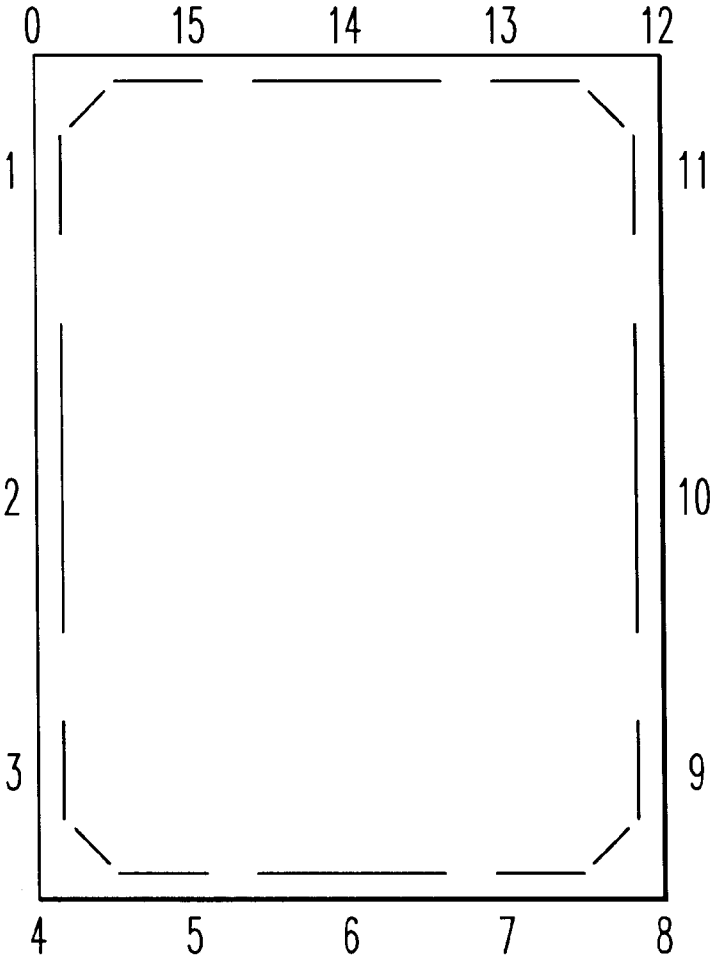
Figure 8:
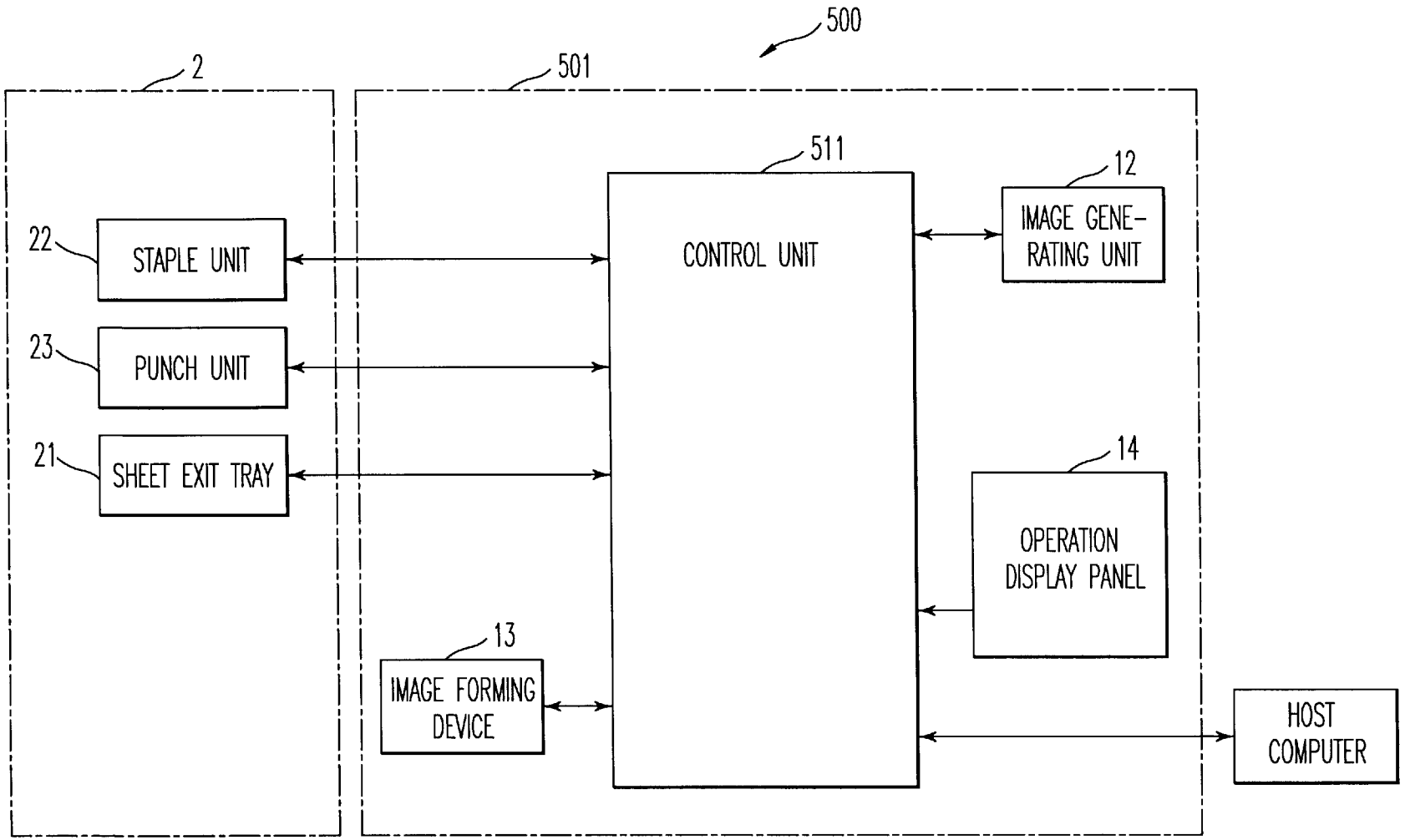
FIG. 8 PRIOR ART
FIG. 8 is a block diagram illustrating a background image forming apparatus including a finishing function.

Numerals indicated in the last two columns (reference columns) of FIGS. 3, 4, 5, and 6 correspond to those indicated in FIGS. 7(*a*) or 7(*b*) and indicate a stapling or punching position for the sheet, respectively. FIG. 7(*a*) illustrates stapling positions (0–15) and FIG. 7(*b*) illustrates punching positions (0–3), each position being denoted by a reference numeral. The stapling positions denoted by numerals 2, 6, 10 and 14 respectively are double stapled positions, although FIGS. 3, 4, 5, and 6 do not illustrate the double stapling.

FIG. 3 is a chart illustrating cases in which the print direction is portrait and the sheet "P" is set in the cassette so that the sheet is fed lengthwise and the short side of the sheet "P" is disposed in the area "M" of the staple/punch unit 20. FIG. 4 is a chart illustrating cases in which the print direction is landscape and the sheet "P" is set so that the sheet is fed lengthwise and the short side of the sheet "P" is disposed in the area "M". FIG. 5 is a chart illustrating cases in which the print direction is portrait and the sheet "P" is set so that the sheet is fed sideways and the long side of the sheet "P" is disposed in the area "M". FIG. 6 is a chart illustrating cases in which the print direction is landscape and the sheet "P" is set so that the sheet is fed sideways and the long side of the sheet "P" is disposed in the area "M".

Referring now to FIG. 3, a reference symbol (a) denotes a case in which the "upper left" position and the "slanting" pattern are designated by a stapling instruction for sheets output on the sheet output tray 21. In this case, because the designated position on the output sheets is out of the area "M", stapling the sheets in the designated position is not possible. Further, even if the image data is rotated 180°, the designated position on the sheets is still out of the area "M" and the staple/punch unit 20 can not staple the sheets as instructed. Consequently, the stapling instruction is deleted from the print command. Further, if the print is duplex and the binding is to be made at the right side (as in paperbacks), the stapling instruction is deleted because the stapling at the "upper left" position contradicts the binding at the right side. Furthermore, the stapling instruction is deleted if the designated sheet size is other than those specified.

A reference symbol (b) in FIG. 3 denotes a case in which the "upper right" position and the "slanting" pattern are designated by a stapling instruction. In this case, although the designated position is out of the area "M", the stapling as designated is possible if the image data is rotated 180°. Therefore, the image data is rotated 180° to be printed on a sheet "P". If the print is duplex and the binding is to be made at the left side (as in dictionaries), the "upper right" position contradicts the left side binding and therefore the stapling instruction is deleted. Further, the stapling instruction is deleted if the designated sheet size is other than those specified.

A reference symbol (c) in FIG. 3 denotes a case in which the "left side" position and the "double" pattern are designated by a stapling instruction. Because the designated position is out of the area "M", the stapling in the designated "left side" position is not possible. Further, even if the image data is rotated 180°, the stapling position is still out of the area "M". Therefore, the stapling instruction is deleted. Also, if the print is duplex and the binding is to be made at the upper or the right side, the "left side" position contradicts the upper side binding and the right side binding, and therefore the stapling instruction is deleted from the print command. Further, the stapling instruction is deleted if the designated sheet size is other than those specified.

A reference symbol (d) in FIG. 3 denotes a case in which the "upper" position and the "double" pattern are designated by a stapling instruction. In this case, stapling is possible if the image data is rotated 180°. Therefore, the image data is rotated 180° to be printed on a sheet "P". If the print is duplex and the binding is to be made at the left or the right side, the "upper" position contradicts the binding position, and therefore the stapling instruction is deleted from the print command. Also, if the designated sheet size is other than those specified, the stapling instruction is deleted.

A reference symbol (e) in FIG. 3 denotes a case in which the "right side" position and the "double" pattern are designated by a stapling instruction. In this case, stapling as requested is not possible because the designated stapling position is out of the area "M". The stapling is not possible even if the image data is rotated 180°. Therefore, the stapling instruction is deleted from the print command. If the print is duplex and the binding is to be made at the upper or the left side, the "right side" position contradicts with the binding positions and therefore, in such a case, the stapling instruction is deleted also. Further, if the designated sheet size is other than those specified, the stapling instruction is deleted.

A reference symbol (f) in FIG. 3 denotes a case in which the "upper left" position and the "horizontal" pattern are designated by a stapling instruction. In this case, although the designated stapling position is out of the area "M", stapling is possible if the image data is rotated 180°. Therefore, the image data is rotated 180° to be printed on a sheet "P". If the print is duplex and the binding at the right side is designated, the stapling instruction is deleted because the "upper left" stapling position contradicts the binding position. The stapling instruction is also deleted if the designated sheet size is other than those specified.

A reference symbol (g) in FIG. 3 denotes a case in which the "upper right" position and the "horizontal" pattern are designated by a stapling instruction. In this case, although the designated stapling position is out of the area "M", stapling is possible if the image data is rotated 180°. Therefore, the image data is rotated 180° to be printed on a sheet "P". If the print is duplex and the left side binding is designated, the "upper right" stapling position contradicts the binding position, and therefore the stapling instruction is deleted. The stapling instruction is deleted also if the designated sheet size is other than those specified.

Referring to FIG. 4, a reference symbol (a) denotes a case in which the "upper left" position and the "slanting" pattern are designated by a stapling instruction. In this case, because the designated position is within the area "M", stapling the sheets in the designated position is possible. If the print is duplex and the binding is to be made at the right side (as in paperbacks), the stapling instruction is deleted because the stapling at the "upper left" position contradicts the binding at the right side. Furthermore, the stapling instruction is deleted if the designated sheet size is other than those specified.

A reference symbol (b) in FIG. 4 denotes a case in which the "upper right" position and the "slanting" pattern are designated by a stapling instruction. In this case, because the designated position is out of the area "M" the stapling is not possible. Further, even if the image data is rotated 180°, the stapling position is still out of the area "M" and the stapling is not possible. Therefore, the stapling instruction is deleted. If the print is duplex and the binding is to be made at the left side (as in dictionaries), the "upper right" position contradicts the left side binding, and therefore the stapling instruction is deleted. Further, the stapling instruction is deleted if the designated sheet size is other than those specified.

A reference symbol (c) in FIG. 4 denotes a case in which the "left side" position and the "double" pattern are designated by a stapling instruction. Because the designated position is within the area "M" the stapling is possible. If the print is duplex and the binding is to be made at the upper or the right side, the "left side" position contradicts the upper side binding and the right side binding, and therefore the stapling instruction is deleted from the print command. Further, the stapling instruction is deleted if the designated sheet size is other than those specified.

A reference symbol (d) in FIG. 4 denotes a case in which the "upper" position and the "double" pattern are designated by a stapling instruction. In this case, because the designated position is out of the area "M" the stapling is not possible. Further, even if the image data is rotated 180°, the stapling position is still out of the area "M" and the stapling is not possible. Therefore, the stapling instruction is deleted. If the print is duplex and the binding is to be made at the left or the right side, the "upper" position contradicts the binding position, and therefore the stapling instruction is deleted from the print command. Also, if the designated sheet size is other than those specified, the stapling instruction is deleted.

A reference symbol (e) in FIG. 4 denotes a case in which the "right side" position and the "double" pattern are designated by a stapling instruction. In this case, although the designated stapling position is out of the area "M", stapling is possible if the image data is rotated 180°. Therefore, the image data is rotated 180° to be printed on a sheet "P". If the print is duplex and the binding is to be made at the upper or the left side, the "right side" position contradicts the binding positions and therefore, in such a case, the stapling instruction is deleted. Further, if the designated sheet size is other than those specified, the stapling instruction is deleted.

A reference symbol (f) in FIG. 4 denotes a case in which the "upper left" position and the "perpendicular" pattern are designated by a stapling instruction. In this case, the designated stapling position is within the area "M" and stapling is possible. If the print is duplex and the binding at the right side is designated, the stapling instruction is deleted because the "upper left" stapling position contradicts the binding position. The stapling instruction is also deleted if the designated sheet size is other than those specified.

A reference symbol (g) in FIG. 4 denotes a case in which the "upper right" position and the "perpendicular" pattern are designated by a stapling instruction. In this case, although the designated stapling position is out of the area "M", stapling is possible if the image data is rotated 180°. Therefore, the image data is rotated 180° to be printed on a sheet "P". If the print is duplex and the left side binding is designated, the "upper right" stapling position contradicts the binding side, and therefore the stapling instruction is deleted. The stapling instruction is deleted also if the designated sheet size is other than those specified.

Referring to FIG. 5, a reference symbol (a) denotes a case in which the "upper left" position and the "slanting" pattern are designated by a stapling instruction. In this case, because the designated position is within the area "M", stapling sheets in the designated position is possible. If the print is duplex and the binding is to be made at the right side (as in paperbacks), the stapling instruction is deleted because the stapling at the "upper left" position contradicts the binding at the right side. Furthermore, the stapling instruction is deleted also if the designated sheet size is other than those specified.

A reference symbol (b) in FIG. 5 denotes a case in which the "upper right" position and the "slanting" pattern are designated by a stapling instruction. In this case, because the designated position is out of the area "M", stapling is not possible. Further, even if the image data is rotated 180°, the stapling position is still out of the area "M" and stapling is not possible. Therefore, the stapling instruction is deleted. If the print is duplex and the binding is to be made at the left side (as in dictionaries), the "upper right" position contradicts the left side binding, and therefore the stapling instruction is deleted. Further, the stapling instruction is deleted if the designated sheet size is other than those specified.

A reference symbol (c) in FIG. 5 denotes a case in which the "left side" position and the "double" pattern are designated by a stapling instruction. Because the designated position is within the area "M", stapling is possible. If the print is duplex and the binding is to be made at the upper or the right side, the "left side" position contradicts the upper side binding and the right side binding, and therefore the stapling instruction is deleted from the print command. Further, the stapling instruction is deleted if the designated sheet size is other than those specified.

A reference symbol (d) in FIG. 5 denotes a case in which the "upper" position and the "double" pattern are designated by a stapling instruction. In this case, because the designated position is out of the area "M", stapling is not possible. Further, even if the image data is rotated 180°, the stapling position is still out of the area "M" and the stapling is not possible. Therefore, the stapling instruction is deleted. Further, if the print is duplex and the binding is to be made at the left or the right side, the "upper" position contradicts the binding side, and therefore the stapling instruction is deleted from the print command. Also, if the designated sheet size is other than those specified, the stapling instruction is deleted.

A reference symbol (e) in FIG. 5 denotes a case in which the "right side" position and the "double" pattern are designated by a stapling instruction. In this case, although the designated stapling position is out of the area "M", stapling is possible if the image data is rotated 180°. Therefore, the image data is rotated 180° to be printed on a sheet "P". If the print is duplex and the binding is to be made at the upper or the left side, the "right side" position contradicts with the binding side and therefore, in such a case, the stapling instruction is deleted. Further, if the designated sheet size is other than those specified, the stapling instruction is deleted.

A reference symbol (f) in FIG. 5 denotes a case in which the "upper left" position and the "perpendicular" pattern are designated by a stapling instruction. In this case, the designated stapling position is within the area "M" and stapling is possible. If the print is duplex and the binding at the right side is designated, the stapling instruction is deleted because the "upper left" stapling position contradicts the binding side. The stapling instruction is also deleted if the designated sheet size is other than those specified.

A reference symbol (g) in FIG. 5 denotes a case in which the "upper right" position and the "perpendicular" pattern are designated by a stapling instruction. In this case, although the designated stapling position is out of the area "M", stapling is possible if the image data is rotated 180°. Therefore, the image data is rotated 180° to be printed on a sheet "P". If the print is duplex and the left side binding is designated, the "upper right" stapling position contradicts the binding side, and therefore the stapling instruction is deleted. The stapling instruction is deleted also if the designated sheet size is other than those specified.

Referring now to FIG. 6, a reference symbol (a) denotes a case in which the "upper left" position and the "slanting" pattern are designated by a stapling instruction. In this case, because the designated position is out of the area "M", stapling the sheets at the designated position is not possible. Further, even if the image data is rotated 180°, the stapling position is still out of the area "M" and the stapling is not possible. Therefore, the stapling instruction is deleted. If the print is duplex and the binding is to be made at the right side (as in paperbacks), the stapling instruction is deleted because the stapling at the "upper left" position contradicts the binding at the right side. Furthermore, the stapling instruction is deleted if the designated sheet size is other than those specified.

A reference symbol (b) in FIG. 6 denotes a case in which the "upper right" position and the "slanting" pattern are designated by a stapling instruction. In this case, although the designated position is out of the area "M", stapling is possible if the image data is rotated 180°. Therefore, the image data is rotated 180° to be printed on a sheet "P". If the print is duplex and the binding is to be made at the left side (as in dictionaries), the "upper right" position contradicts the left side binding, and therefore the stapling instruction is deleted. Further, the stapling instruction is deleted if the designated sheet size is other than those specified.

A reference symbol (c) in FIG. 6 denotes a case in which the "left side" position and the "double" pattern are designated by a stapling instruction. Because the designated position is out of the area "M", stapling is not possible. Further, even if the image data is rotated 180°, the stapling position is still out of the area "M" and stapling is not possible. Therefore, the stapling instruction is deleted. If the print is duplex and the binding is to be made at the upper or the right side, the "left side" position contradicts the upper side binding and the right side binding, and therefore the stapling instruction is deleted from the print command. Further, the stapling instruction is deleted if the designated sheet size is other than those specified.

A reference symbol (d) in FIG. 6 denotes a case in which the "upper" position and the "double" pattern are designated by a stapling instruction. In this case, although the designated position is out of the area "M", stapling is possible if the image data is rotated 180°. Therefore, the image data is rotated 180° to be printed on a sheet "P". If the print is duplex and the binding is to be made at the left or the right side, the "upper" position contradicts the binding side, and therefore the stapling instruction is deleted from the print command. Also, if the designated sheet size is other than those specified, the stapling instruction is deleted.

A reference symbol (e) in FIG. 6 denotes a case in which the "right side" position and the "double" pattern are designated by a stapling instruction. In this case, the designated stapling position is out of the area "M", and therefore stapling is not possible. Even if the image data is rotated 180°, the designated position is still out of the area "M". Therefore, the stapling instruction is deleted. If the print is duplex and the binding is to be made at the upper or the left side, the "right side" position contradicts with the binding side and therefore, in such a case, the stapling instruction is deleted. Further, if the designated sheet size is other than those specified, the stapling instruction is deleted.

A reference symbol (f) in FIG. 6 denotes a case in which the "upper left" position and the "horizontal" pattern are designated by a stapling instruction. In this case, although the designated position is out of the area "M", stapling is possible if the image data is rotated 180°. Therefore, the image data is rotated 180° to be printed on a sheet "P". If the print is duplex and the binding at the right side is designated, the stapling instruction is deleted because the "upper left" stapling position contradicts the binding side. The stapling instruction is also deleted if the designated sheet size is other than those specified.

A reference symbol (g) in FIG. 6 denotes a case in which the "upper right" position and the "horizontal" pattern are designated by a stapling instruction. In this case, although the designated stapling position is out of the area "M", stapling is possible if the image data is rotated 180°. Therefore, the image data is rotated 180° to be printed on a sheet "P". If the print is duplex and the left side binding is designated, the "upper right" stapling position contradicts the binding side, and therefore the stapling instruction is deleted. The stapling instruction is deleted also if the designated sheet size is other than those specified.

The determination as to whether stapling as designated is possible is made as described above. Now, returning back to FIG. 2, in step S206, the image data stored in the RAM is printed on a print sheet "P" and the sheet "P" is output to the sheet output tray 21. In step S207, then, the sheet "P" is stapled in accordance with the stapling instruction. In case the stapling instruction is deleted, printing is continued without performing the stapling operation. Therefore, printing productivity is enhanced. Further, if the stapling instruction contradicts the binding instruction included in the print command for a duplex print, the stapling instruction is deleted. Therefore, such an inconvenience as removing undesired stapling is avoided. Further, image data is rotated 180° so that stapling can be applied when it is determined that stapling is possible if the image data is rotated 180°. Therefore, the number of cases in which stapling is applied increases, and consequently stapling productivity is enhanced.

Next, how the determination is made as to whether punching as instructed is possible is explained referring to FIGS. 3, 4, 5, 6 again. The determination is made based upon the same information as in the stapling operations of "left", "right", "upper" and "double" stapling as this is the same information for the punching operations. That is, because punching is generally made in two locations at an "upper", "left" or "right" side of a sheet "P", explanation is made for cases in which a punching instruction designates the "left" or "right" or "upper" position.

Referring to FIG. 3, a reference symbol (c) denotes a case in which the "left" position and the "double" pattern are designated by a punching instruction. In this case, because the designated position is out of the area "M", punching is not possible. Further, even if the image data is rotated 180°, the punching is not possible. Therefore, the punching instruction is deleted. Further, if the print is duplex and the upper or the right side binding is designated, the "left" position punching contradicts the binding side. Therefore, the punching instruction is deleted. The punching instruction is also deleted if the designated sheet size is other than those specified.

A reference symbol (d) denotes a case in which the "upper" position and the "double" pattern are designated by a punching instruction. In this case, although the designated position is out of the area "M", punching is possible if the image data is rotated 180°. Therefore, the image data is rotated 180° to be printed on a sheet "P". If the print is duplex and the "left" or "right" binding is to be made, the "upper" position punching contradicts the binding side. Therefore , the punching instruction is deleted. The punching instruction is also deleted if the designated sheet size is other than those specified.

A reference symbol (e) in FIG. 3 denotes a case in which the "right" position and the "double" pattern are designated by a punching instruction. In this case, the designated position is out of the area "M", and therefore punching is not possible. Punching is not possible even if the image data is rotated 180°. Therefore, the punching instruction is deleted. Further, if the print is duplex, and the "upper" or "left" binding is to be made, the "right" punching position contradicts the binding side. Therefore, the punching instruction is deleted. The punching instruction is also deleted if the designated sheet size is other than those specified.

Referring to FIG. 4, a reference symbol (c) denotes a case in which the "left" position and the "double" pattern are designated by a punching instruction. In this case, the designated position is within the area "M", and therefore punching is possible. If the print is duplex and the upper or the right side binding is designated, the "left" position punching contradicts the binding side. Therefore, in such a case, the punching instruction is deleted. The punching instruction is also deleted if the designated sheet size is other than those specified.

A reference symbol (d) in FIG. 4 denotes a case in which the "upper" position and the "double" pattern are designated by a punching instruction. In this case, because the designated position is out of the area "M", punching is not possible. Even if the image data is rotated 180°, punching is not possible. Therefore, the punching instruction is deleted. Further, if the print is duplex and the "left" or "right" binding is to be made, the "upper" position punching contradicts the binding side. Therefore, in such a case, the punching instruction is deleted. The punching instruction is also deleted if the designated sheet size is other than those specified.

A reference symbol (e) in FIG. 4 denotes a case in which the "right" position and the "double" pattern are designated by a punching instruction. In this case, the designated position is out of the area "M". However, the punching is possible if the image data is rotated 180°. Therefore, the image data is rotated 180° to be printed on a sheet "P". If the print is duplex and the "upper" or "left" binding is to be made, the "right" punching position contradicts the binding side. Therefore, the punching instruction is deleted. The punching instruction is also deleted if the designated sheet size is other than those specified.

Referring to FIG. 5, a reference symbol (c) denotes a case in which the "left" position and the "double" pattern are designated by a punching instruction. In this case, the designated position is within the area "M", and therefore punching is possible. If the print is duplex and the upper or the right side binding is designated, the "left" position punching contradicts the binding side. Therefore, in such a case, the punching instruction is deleted. The punching instruction is also deleted if the designated sheet size is other than those specified.

A reference symbol (d) in FIG. 5 denotes a case in which the "upper" position and the "double" pattern are designated by a punching instruction. In this case, because the designated position is out of the area "M", punching is not possible. Even if the image data is rotated 180°, the punching is not possible. Therefore, the punching instruction is deleted. If the print is duplex and the "left" or "right" binding is to be made, the "upper" position punching contradicts the binding side. Therefore, in such a case, the punching instruction is deleted. The punching instruction is also deleted if the designated sheet size is other than those specified.

A reference symbol (e) in FIG. 5 denotes a case in which the "right" position and the "double" pattern are designated by a punching instruction. In this case, the designated position is out of the area "M". However, punching is possible if the image data is rotated 180°. Therefore, the image data is rotated 180° to be printed on a sheet "P". If the print is duplex and the "upper" or "left" binding is to be made, the "right" punching position contradicts the binding side. Therefore, in such a case, the punching instruction is deleted. The punching instruction is also deleted if the designated sheet size is other than those specified.

Referring to FIG. 6, a reference symbol (c) denotes a case in which the "left" position and the "double" pattern are designated by a punching instruction. In this case, because the designated position is out of the area "M", punching is not possible. Even if the image data is rotated 180°, punching is not possible. Therefore, the punching instruction is deleted. If the print is duplex and the upper or the right side binding is designated, the "left" position punching contradicts the binding side. Therefore, in such a case, the punching instruction is deleted. The punching instruction is also deleted if the designated sheet size is other than those specified.

A reference symbol (d) in FIG. 6 denotes a case in which the "upper" position and the "double" pattern are designated by a punching instruction. In this case, the designated position is out of the area "M". However, punching is possible if the image data is rotated 180°. Therefore, the image data is rotated 180° to be printed on a sheet "P". If the print is duplex and the "left" or "right" binding is to be made, the "upper" position punching contradicts the binding side. Therefore, in such a case, the punching instruction is deleted. The punching instruction is also deleted if the designated sheet size is other than those specified.

A reference symbol (e) in FIG. 6 denotes a case in which the "right" position and the "double" pattern are designated by a punching instruction. In this case, the designated position is out of the area "M", and therefore punching is not possible. Further, even if the image data is rotated 180°, punching is not possible. Therefore, the punching instruction is deleted. Further, if the print is duplex and the "upper" or "left" binding is to be made, the "right" punching position contradicts the binding side. Therefore, in such a case, the punching instruction is deleted. The punching instruction is also deleted if the designated sheet size is other than those specified.

Thus, the determination is made as to whether a punching instruction should be deleted. Now, returning back to FIG. 2, in step S206, the image data stored in the RAM is printed on a print sheet "P" and the sheet "P" is output to the sheet output tray 21. In step S207, then, the sheet "P" is punched in accordance with the punching instruction. If the punching instruction is deleted, printing is continued without performing the punching operation. Therefore, printing productivity is enhanced. Further, if the punching instruction contradicts the binding instruction included in the print command for a duplex print, the punching instruction is deleted. Therefore, such an inconvenience as to perform a punching operation again is avoided. Further, the image data is rotated 180° so that punching can be applied when it is determined that punching is possible if the image data is rotated 180°. Therefore, the number of cases in which punching is applied increases, and consequently punching productivity is enhanced.

Next, how the determination is made as to whether punching as instructed is possible when both a stapling instruction and a punching instruction are made at the same time is explained referring to FIGS. 3, 4, 5 and 6. A reference number for the punching which is allowed to be performed is indicated in a parenthesis in the last column of FIGS. 3, 4, 5, and 6 for each case. An indication of deleting a punching instruction is omitted in each of these FIGS. 3, 4, 5, and 6.

Referring to FIG. 3, in the case (b) in which the "upper right" position and the "slanting" pattern are designated for stapling, punching should be made in a position corresponding to the stapling position. In this case, the punching position should be the "upper" position and the punching pattern should be "double" pattern. Therefore, if a punching instruction designates other positions and patterns, then such a punching instruction is deleted.

In the case (d) of FIG. 3 in which the "upper" position and the "double" pattern are designated for stapling, the punching position should be the "upper" position and the punching pattern should be the "double" pattern. Therefore, if a punching instruction designates other positions and patterns, then the punching instruction is deleted.

In the case of (f) of FIG. 3 in which the "upper left" position and the "horizontal" pattern are designated for stapling, the punching position should be the "upper" position and the punching pattern should be the "double" pattern. Therefore, if a punching instruction designates other positions and patterns, then the punching instruction is deleted.

In the case of (g) of FIG. 3 in which the "upper right" position and the "horizontal" pattern are designated for stapling, the punching position should be the "upper" position and the punching pattern should be the "double" pattern. Therefore, if a punching instruction designates other positions and patterns, the punching instruction is deleted.

In the case of (a) of FIG. 4 in which the "upper left" position and the "slanting" pattern are designated for stapling, the punching position should be the "left" position and the punching pattern should be the "double" pattern. Therefore, if a punching instruction designates other positions and patterns, the punching instruction is deleted.

In the case of (c) of FIG. 4 where the "left" position and the "double" pattern are designated for stapling, the punching position should be the "left" position and the punching pattern should be the "double" pattern. Therefore, if a punching instruction designates other positions and patterns, the punching instruction is deleted.

In the case of (e) of FIG. 4 in which the "right" position and the "double" pattern are designated for stapling, the punching position should be the "right" position and the punching pattern should be the "double" pattern. Therefore, if a punching instruction designates other positions and patterns, the punching instruction is deleted.

In the case of (f) of FIG. 4 in which the "upper left" position and the "perpendicular" pattern are designated for stapling, the punching position should be the "left" position and the punching pattern should be the "double" pattern. Therefore, if a punching instruction designates other positions and patterns, the punching instruction is deleted.

In the case of (g) of FIG. 4 in which the "upper right" position and the "perpendicular" pattern are designated for stapling, the punching position should be the "right" position and the punching pattern should be the "double" pattern. Therefore, if a punching instruction designates other positions and patterns, the punching instruction is deleted.

In the case of (a) of FIG. 5 where the "upper left" position and the "slanting" pattern are designated for stapling, the punching position should be the "left" position and the punching pattern should be the "double" pattern. Therefore, if a punching instruction designates other positions and patterns, the punching instruction is deleted.

In the case of (c) of FIG. 5 in which the "left" position and the "double" pattern are designated for stapling, the punching position should be the "left" position and the punching pattern should be the "double" pattern. Therefore, if a punching instruction designates other positions and patterns, the punching instruction is deleted.

In the case of (e) of FIG. 5 where the "right" position and the "double" pattern are designated for stapling, the punching position should be the "right" position and the punching pattern should be the "double" pattern. Therefore, if a punching instruction designates other positions and patterns, the punching instruction is deleted.

In the case of (f) of FIG. 5 in which the "upper left" position and the "perpendicular" pattern are designated for stapling, the punching position should be the "left" position and the punching pattern should be the "double" pattern. Therefore, if a punching instruction designates other positions and patterns, the punching instruction is deleted.

In the case of (g) of FIG. 5 in which the "upper right" position and the "perpendicular" pattern are designated for stapling, the punching position should be the "right" position and the punching pattern should be the "double" pattern. Therefore, if a punching instruction designates other positions and patterns, the punching instruction is deleted.

In the case of (b) of FIG. 6 in which the "upper right" position and the "slanting" pattern are designated for stapling, the punching position should be the "upper" position and the punching pattern should be the "double" pattern. Therefore, if a punching instruction designates other positions and patterns, the punching instruction is deleted.

In the case of (d) of FIG. 6 in which the "upper" position and the "double" pattern are designated for stapling, the punching position should be the "upper" position and the punching pattern should be the "double" pattern. Therefore, if a punching instruction designates other positions and patterns, the punching instruction is deleted.

In the case of (f) of FIG. 6 in which the "upper left" position and the "horizontal" pattern are designated for stapling, the punching position should be the "upper" position and the punching pattern should be the "double" pattern. Therefore, if a punching instruction designates other positions and patterns, the punching instruction is deleted.

In the case of (g) of FIG. 6 in which the "upper right" position and the "horizontal" pattern are designated for stapling, the punching position should be the "upper" position and the punching pattern should be the "double" pattern. Therefore, if a punching instruction designates other positions and patterns, the punching instruction is deleted.

Thus, if a punching instruction designates other positions and patterns than those as specified, the punching instruction is deleted from the print command. Therefore, it is avoided that punching is applied in a position which contradicts the stapling position. The determination as to whether stapling or punching is possible is made as described earlier. Therefore, even if the stapling instruction and the punching instruction do not contradict each other, the stapling or the punching may or may not be performed based upon the determination to be made as described earlier.

Numerous additional modifications and variations of the present invention are possible in light of the above teachings. It is therefore to be understood that within the scope of the appended claims, the present invention may be practiced otherwise than as specifically described herein.

This application is based upon Japanese patent application No. 09-048305 filed in the Japanese Patent Office on Mar. 3, 1997, and the entire contents of which are hereby incorporated by reference.

I claim:

1. An image forming apparatus comprising:

an image forming device which forms an image on a sheet;

an output sheet receiving unit which receives the sheet output from the image forming device;

a staple device which staples the sheet output from the image forming device in a predetermined area relative to the output sheet receiving unit;

a staple position designating device which designates a staple position for the output sheet;

a staple instructing device which gives a staple instruction to the staple device to staple the sheet in the designated staple position;

a staple instruction deleting device which deletes the staple instruction when the designated staple position is out of the predetermined area;

a punch device which punches the sheet output from the image forming device in the predetermined area relative to the output sheet receiving unit;

a punch position designating device which designates a punch position for the output sheet;

a punch instructing device which gives a punch instruction to the punch device to punch the sheet in the designated punch position; and a punch instruction deleting device which deletes the punch instruction when the designated punch position is out of the predetermined area; and wherein the punch instruction deleting device deletes the punch instruction when both the staple instruction and the punch instruction are made at the same time, and if the designated staple position and the designated punch position contradict each other.

2. An image forming apparatus comprising:

an image forming device which forms an image on a sheet according to a print instruction including a staple instruction designating a staple position for the sheet, and a punch instruction designating a punch position for the sheet, and which outputs the sheet carrying the image to an output sheet receiving unit;

a staple device which staples the output sheet in a predetermined area relative to the output sheet receiving unit in accordance with the staple instruction;

a staple instruction deleting device which deletes the staple instruction from the print instruction when the designated staple position is out of the predetermined area;

a punch device which punches the sheet output from the image forming apparatus in the predetermined area relative to the output sheet receiving unit; and a punch instruction deleting device which deletes the punch instruction from the print instruction when the designated punch position is out of the predetermined area; and wherein the punch instruction deleting device deletes the punch instruction from the print instruction when both the staple instruction and the punch instruction are made at the same time, and if the designated staple position and the designated punch position contradict each other.

* * * * *